US011110321B2

(12) United States Patent
Madson et al.

(10) Patent No.: US 11,110,321 B2
(45) Date of Patent: Sep. 7, 2021

(54) GOLF BALL DIMPLES HAVING CIRCUMSCRIBED PRISMATOIDS

(71) Applicant: Acushnet Company, Fairhaven, MA (US)

(72) Inventors: Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 16/877,302

(22) Filed: May 18, 2020

(65) Prior Publication Data

US 2020/0276480 A1 Sep. 3, 2020

Related U.S. Application Data

(63) Continuation-in-part of application No. 13/732,033, filed on Dec. 31, 2012, now abandoned, which is a continuation-in-part of application No. 13/684,682, filed on Nov. 26, 2012, now Pat. No. 8,926,453, which is a continuation of application No. 12/584,595, filed on Sep. 9, 2009, now Pat. No. 8,317,638.

(51) Int. Cl.
*A63B 37/00* (2006.01)
*A63B 37/14* (2006.01)

(52) U.S. Cl.
CPC ..... *A63B 37/0012* (2013.01); *A63B 37/002* (2013.01); *A63B 37/0004* (2013.01); *A63B 37/0005* (2013.01); *A63B 37/0015* (2013.01); *A63B 37/0016* (2013.01); *A63B 37/0019* (2013.01)

(58) Field of Classification Search
CPC ..... A63B 37/0012; A63B 37/0004; A63B 37/0005; A63B 37/0019; A63B 37/0015; A63B 37/0009
USPC ..... 473/365, 383
See application file for complete search history.

(56) References Cited

U.S. PATENT DOCUMENTS

| | | | | |
|---|---|---|---|---|
| 5,338,039 | A * | 8/1994 | Oka | A63B 37/0004 473/384 |
| 5,735,757 | A * | 4/1998 | Moriyama | A63B 37/0004 473/384 |
| 2001/0036872 | A1* | 11/2001 | Kasashima | A63B 37/002 473/378 |
| 2005/0014579 | A1* | 1/2005 | Asakura | A63B 37/0012 473/378 |
| 2006/0142098 | A1* | 6/2006 | Sajima | A63B 37/0012 473/378 |
| 2007/0015609 | A1* | 1/2007 | Kasashima | A63B 37/0009 473/383 |
| 2011/0059813 | A1* | 3/2011 | Madson | A63B 37/0016 473/383 |
| 2013/0123048 | A1* | 5/2013 | Madson | A63B 37/0015 473/384 |

* cited by examiner

*Primary Examiner* — John E Simms, Jr.
(74) *Attorney, Agent, or Firm* — Steven M. Landolfi, Jr.

(57) ABSTRACT

The present invention relates to golf balls, specifically, to a golf ball with multifaceted dimples comprising two discrete geometries including a circular perimeter and a depression or protrusion based on a polyhedral prismatoid.

18 Claims, 17 Drawing Sheets

GOLF BALL DIMPLES HAVING CIRCUMSCRIBED PRISMATOIDS

CROSS-REFERENCE TO RELATED APPLICATIONS

This application is a continuation-in-part of U.S. patent application Ser. No. 13/732,033, filed Dec. 31, 2012, which is a continuation-in-part of U.S. patent application Ser. No. 13/684,682, filed Nov. 26, 2012, now U.S. Pat. No. 8,926,453, which is a continuation of U.S. patent application Ser. No. 12/584,595, filed Sep. 9, 2009, now U.S. Pat. No. 8,317,638, the entire disclosures of which are hereby incorporated herein by reference.

FIELD OF THE INVENTION

The present invention relates to golf balls, specifically, to a golf ball with multifaceted dimples comprising two discrete geometries.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities and thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag. It is the circumference portion of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. Also, the circumference portion of each dimple is important in optimizing this flow phenomenon.

By using dimples to decrease drag and increase lift, almost every golf ball manufacturer has increased their golf ball flight distances. In order to optimize ball performance, it is desirable to have a large number of dimples, thus a large amount of dimple circumference, which are evenly distributed around the ball. In arranging the dimples, an attempt is made to minimize the space between dimples, because such space does not improve aerodynamic performance of the ball. In practical terms, this usually translates into 300 to 500 circular dimples with a conventional-sized dimple having a diameter that ranges from about 0.120 inches to about 0.180 inches.

One approach for maximizing the aerodynamic performance of golf balls is suggested in U.S. Pat. No. 6,162,136 ("the '136 patent), wherein a preferred solution is to minimize the land surface or undimpled surface of the ball. The '136 patent also discloses that this minimization should be balanced against the durability of the ball. Since as the land surface decreases, the susceptibility of the ball to premature wear and tear by impacts with the golf club increases.

Based on the significant role that dimples play in golf ball design, manufacturers continually seek to develop novel dimple patterns, sizes, shapes, volumes, cross-sections, etc. Thus, the present invention provides a novel dimple shape having unique aesthetic and aerodynamic characteristics.

SUMMARY OF THE INVENTION

The present invention is directed to a golf ball with improved dimples. The present invention is also directed to a golf ball with improved aerodynamic characteristics. These and other embodiments of the present invention are realized by a golf ball comprising a spherical outer land surface and a plurality of dimples formed thereon.

In one embodiment, the present invention is directed to a golf ball having recessed dimples on the surface thereof, wherein at least one dimple comprises a first circular perimeter located at the chord plane, a second circular perimeter located below the chord plane, and a prismatoid depression or protrusion having a base with a plurality of vertices that are in contact with the second circular perimeter.

In another embodiment, the present invention is directed to a golf ball having recessed dimples on the surface thereof, wherein at least one dimple comprises a first circular perimeter located at the chord plane, a second circular perimeter located below the chord plane and having the same diameter as the first circular perimeter, and a prismatoid depression or protrusion having a base with a plurality of vertices that are not in contact with the second circular perimeter.

In another embodiment, the present invention is directed to a golf ball having recessed dimples on the surface thereof, wherein at least one dimple comprises an upper dimple defined by a circular perimeter located at the chord plane and an upper dimple sidewall, wherein the upper dimple sidewall terminates at an intersection with a prismatoid depression or protrusion.

In another embodiment, the present invention is directed to a golf ball having recessed dimples on the surface thereof, wherein at least one dimple consists of an upper dimple portion, a lower dimple portion, and a spherical cap. The upper dimple portion is defined by a circular perimeter located at the chord plane, and an upper dimple sidewall, wherein the cross-sectional profile shape of the upper dimple sidewall is defined by a spherical function. The lower dimple portion is defined by a depression having the shape of a portion of a prismatoid, wherein the prismatoid is formed by connecting each of the vertices of a polygonal base to an apex to form a pyramid consisting of the polygonal base and a plurality of triangular faces joined along a plurality of side edges, wherein the surface shape of the lower dimple portion includes at least a portion of each of the triangular faces. In a particular aspect of this embodiment, a flat transitional surface connects the upper dimple portion and the lower dimple portion, and the lower dimple portion intersects with the spherical cap along a curved interface defined by the curve of intersection of the lower dimple portion and the spherical cap. In another particular aspect of this embodiment, the upper dimple portion intersects with the lower dimple portion along a curved interface defined by the curve of intersection of the upper dimple sidewall and the lower dimple portion, and the lower dimple portion intersects with the spherical cap along a curved interface defined by the curve of intersection of the lower dimple portion and the spherical cap.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION

The invention provides for at least one dimple having multifaceted depressions which include two distinct geometries.

In one embodiment, a first perimeter is concentric about a second, smaller perimeter which circumscribes a prismatoid depression or protrusion. Primarily the first and second perimeters are circular and the depressions or protrusions are based on a polyhedral prismatoid. In a particular aspect of this embodiment, the ratio of the first and second diameters is defined by:

$$r_c = \frac{D_S}{D_D}$$

wherein:

$r_c$ is the circle ratio, $D_D$ is the diameter of the first circular perimeter, $D_S$ is the diameter of the second circular perimeter, and the range of values for $r_c$ is about 0.25 to about 0.90.

For purposes of the present disclosure, the term "circumscribes" refers to a perimeter being in contact with the vertices of the base of a prismatoid.

In a particular embodiment of the present invention, the prismatoid maintains a minimum of three and a maximum of twelve edges, and is selected from pyramids, cupolas, and frusta.

Figure 1:
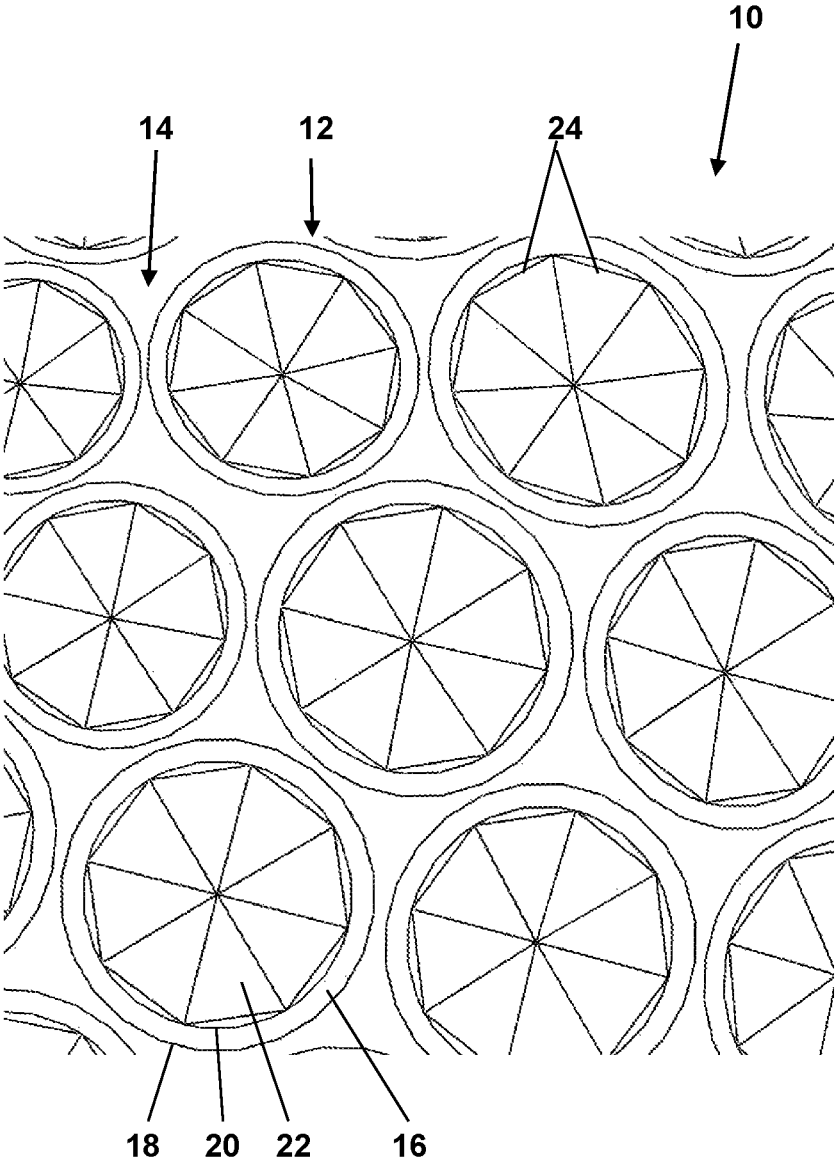
FIG. 1 is a partial surface of a golf ball having an eight-edged prismatoid depression in each dimple.

Referring now to the Figures, as shown generally in FIG. 1, where like numbers designate like parts, reference number 10 broadly designates a partial surface of a golf ball 10 having a plurality of dimples 12 separated by outer undimpled or land surface 14. In accordance to one aspect of the present invention as shown in FIG. 1, the dimples 12 are formed as multifaceted depressions, each dimple comprising two discrete geometries; a first depression 16 having a first larger circular perimeter 18, and a second, smaller circular diameter 20 concentric within the larger circular perimeter 18 and circumscribing a prismatoid depression 22.

As shown in FIGS. 1-4 and 8-11, in one embodiment, dimple 12 has a first circular perimeter 32 located at the chord plane and a second circular perimeter 34 located below the chord plane and marking the termination of upper dimple sidewall 36. Circumscribed by second circular perimeter 34 is a depression or protrusion 40 based on a polyhedral prismatoid whose base is normal to the dimple axis. The prismatoid does not intersect the phantom spherical ball surface.

Figure 9:
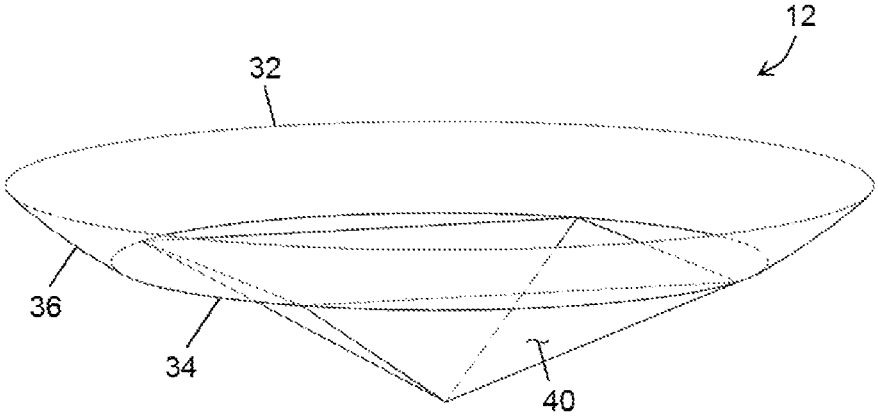
FIG. 9 is an enlarged perspective view illustrating a dimple according to an embodiment of the present invention.
Figure 10A:
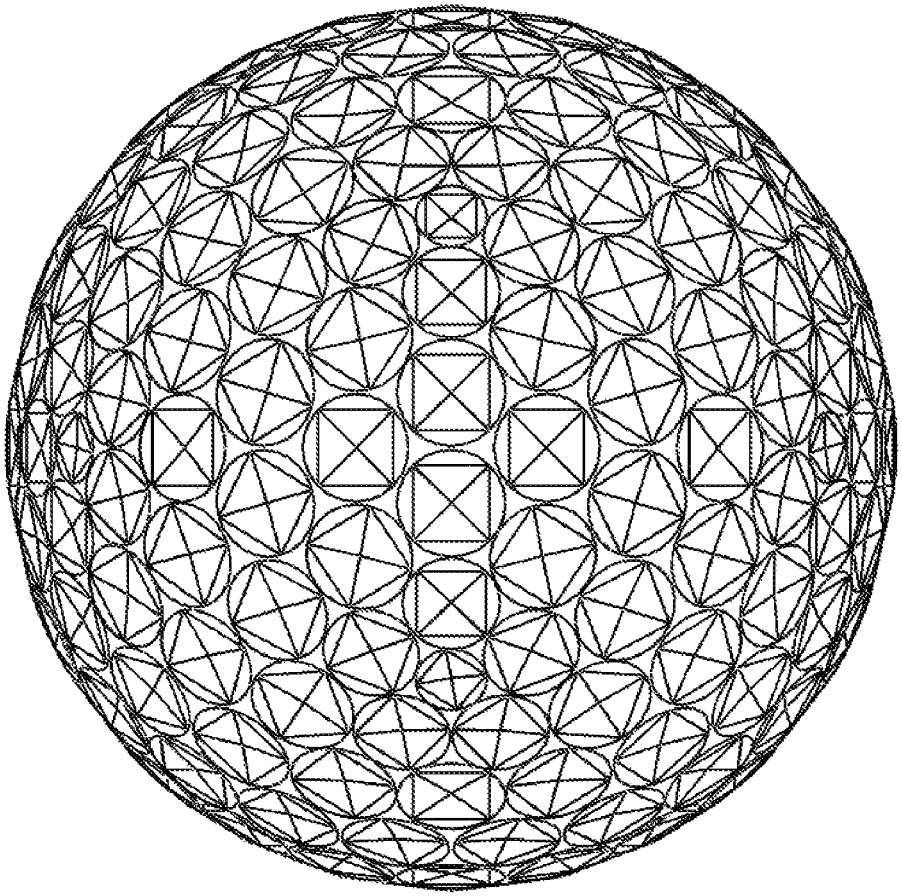
FIG. 10A shows a golf ball with multifaceted depressions according to an embodiment of the present invention.
Figure 10B:
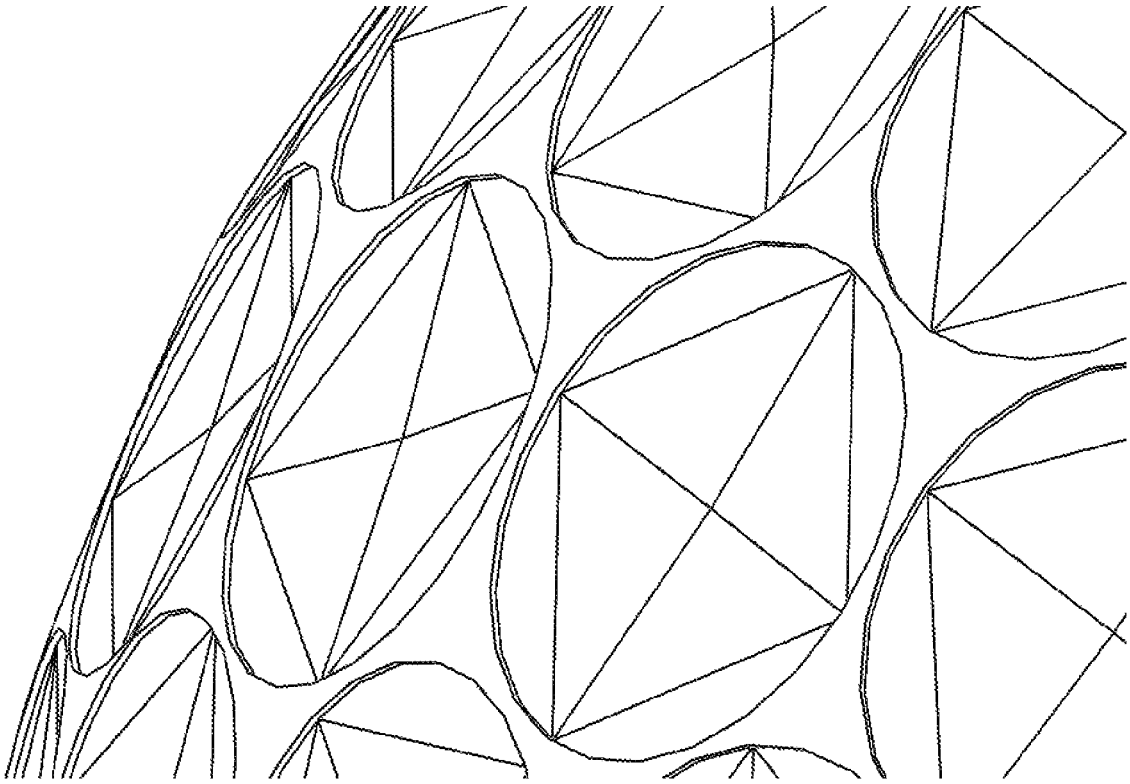
FIG. 10B shows a partial surface of the golf ball shown in FIG. 10A.
Figure 11:
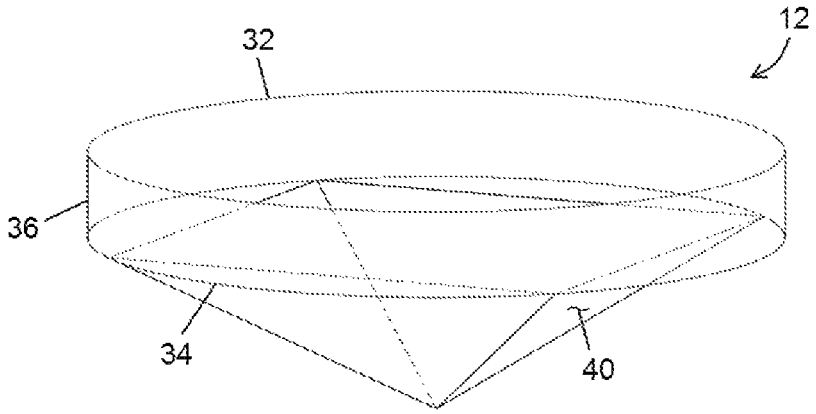
FIG. 11 is an enlarged perspective view illustrating a dimple according to an embodiment of the present invention.

According to one aspect of this embodiment, as shown in FIGS. 1-4, 8 and 9, second circular perimeter 34 is concentric within first circular perimeter 32. In FIG. 9, the cross-sectional profile of upper dimple sidewall 36 is defined by a spherical function, but may be defined by any suitable function selected from linear, polynomial, posynomial, trigonometric, hyperbolic, exponential functions, and the like. According to another aspect of this embodiment, as shown in FIGS. 10A, 10B and 11, second circular perimeter 34 has the same diameter as first circular perimeter 32.

Figure 12:
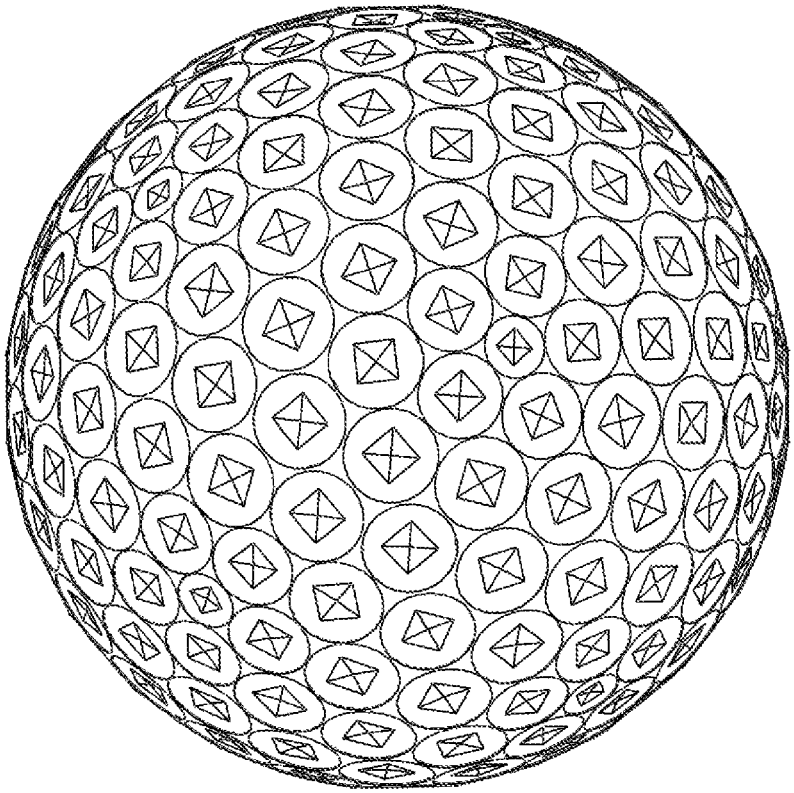
FIG. 12 shows a golf ball with multifaceted depression according to an embodiment of the present invention.
Figure 13:
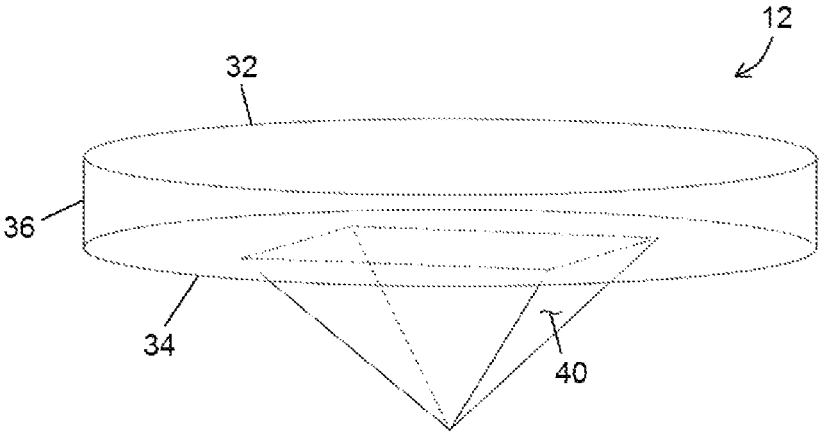
FIG. 13 is an enlarged perspective view illustrating a dimple according to an embodiment of the present invention.

As shown in FIGS. 12 and 13, in another embodiment, dimple 12 has a first circular perimeter 32 located at the chord plane and a second circular perimeter 34, having the same diameter as first circular perimeter 32, located below the chord plane and marking the termination of upper dimple sidewall 36. Concentric within but not circumscribed by second circular perimeter 34 is a depression or protrusion 40 based on a polyhedral prismatoid whose base is normal to the dimple axis. The prismatoid does not intersect the phantom spherical ball surface.

For purposes of the present disclosure, the first circular perimeter and the second circular perimeter have the same diameter if their diameters are within 3% of each other to allow for manufacturing variances.

Figure 14:
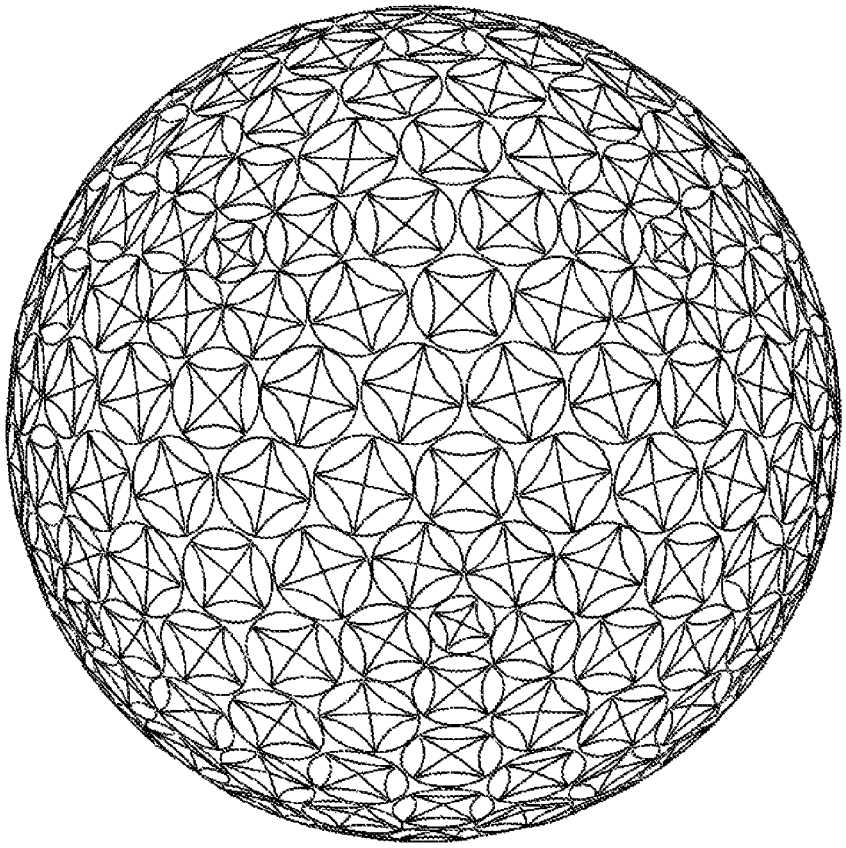
FIG. 14 shows a golf ball with multifaceted depression according to an embodiment of the present invention.
Figure 15:
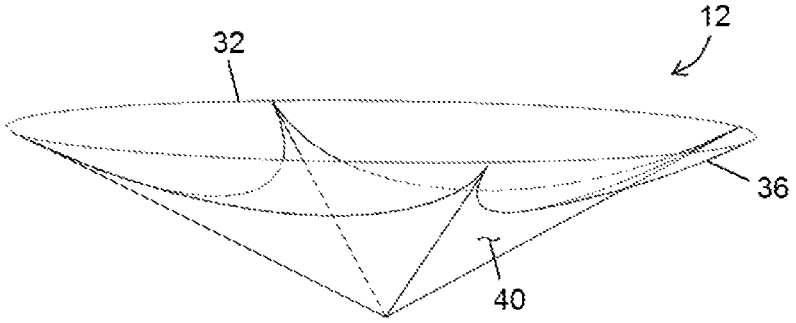
FIG. 15 is an enlarged perspective view illustrating a dimple according to an embodiment of the present invention.
Figure 16:
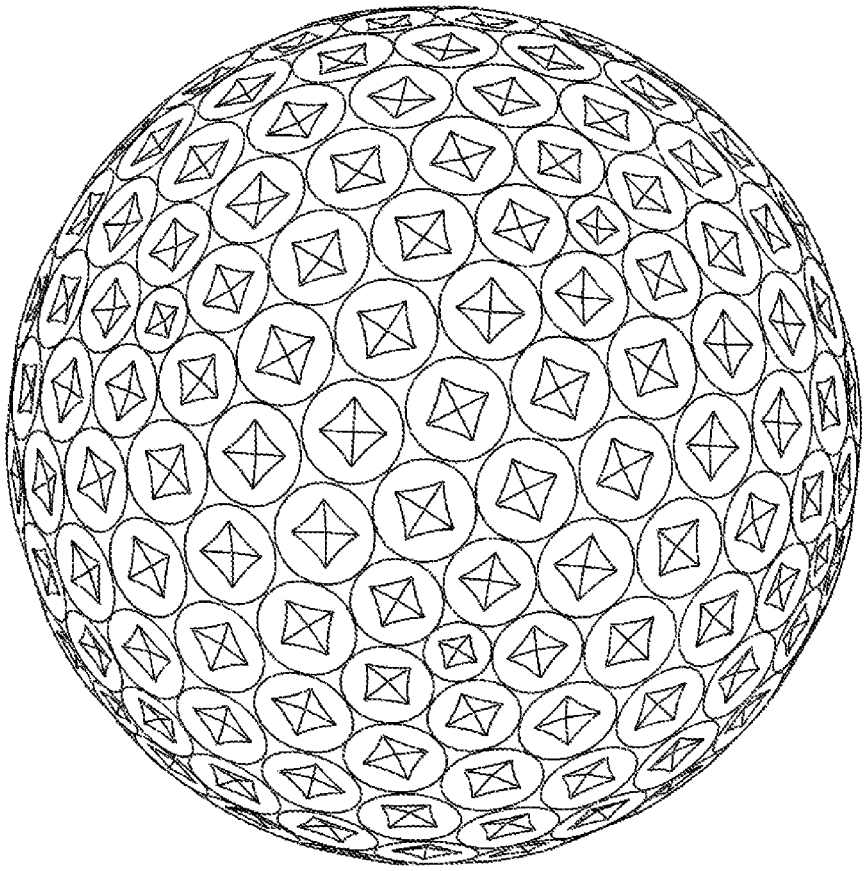
FIG. 16 shows a golf ball with multifaceted depression according to an embodiment of the present invention.
Figure 17:
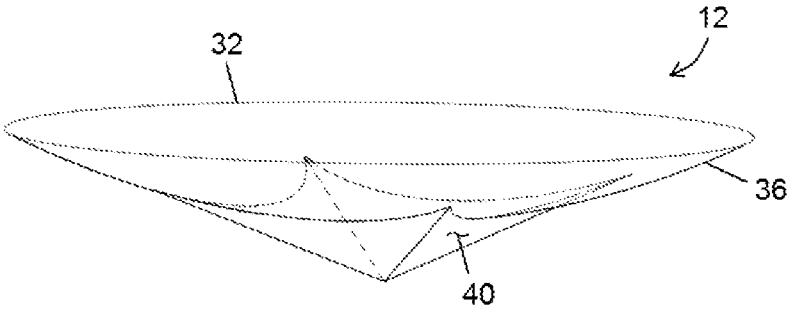
FIG. 17 is an enlarged perspective view illustrating a dimple according to an embodiment of the present invention.

As shown in FIGS. 14-17, in another embodiment, dimple 12 has a circular perimeter 32 located at the chord plane and an upper dimple sidewall 36 which terminates at an intersection with a prismatoid depression or protrusion 40. In FIGS. 15 and 17, the cross-sectional profile of sidewall 36 is defined by a spherical function, but may be defined by any suitable function selected from linear, polynomial, posynomial, trigonometric, hyperbolic, exponential functions, and the like.

According to one aspect of this embodiment, as shown in FIGS. 14 and 15, the vertices of the base of prismatoid 40 are located at the chord plane and, thus, are in contact with circular perimeter 32. According to another aspect of this embodiment, as shown in FIGS. 16 and 17, the vertices of the base of prismatoid 40 are located below the chord plane and, thus, are not in contact with circular perimeter 32.

In any of the embodiments disclosed herein, the prismatoid is optionally further defined by an intersecting plane that is parallel or oblique to the prismatoid base forming a truncated prism or cupola.

To maintain adjustability of dimple parameters, the base of the prismatoid maintains a minimum of three and a maximum of twelve edges ($N_E$):

$$3<N_E<12 \qquad \text{Equation 1}$$

Figure 2:
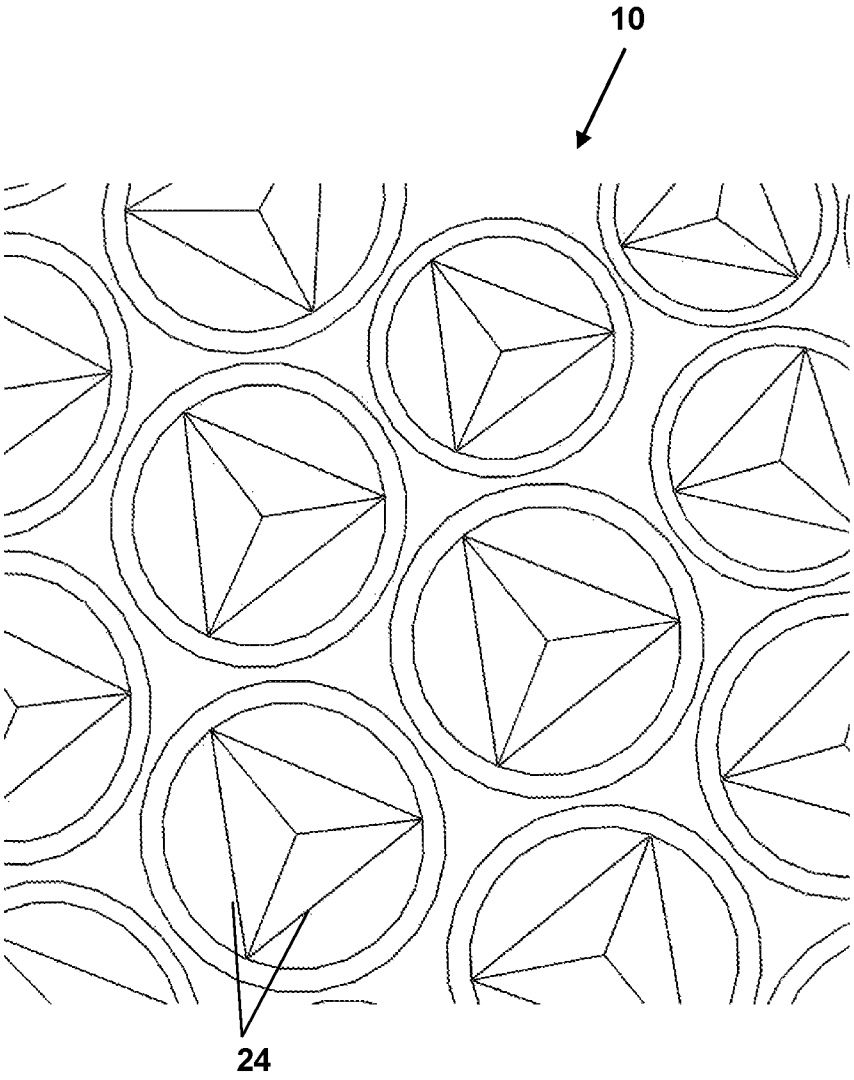
FIG. 2 is a partial surface of a golf ball having a three-edged prismatoid depression in each dimple.

An example of a dimple prismatoid having eight (8) edges 24 is shown in FIG. 1, while one having 3 edges 24 is shown in FIG. 2.

To allow for manufacturing and adjustability of the dimple, the shape must adhere to a particular circle ratio ($r_c$), such that the ratio of diameters ($D_D$) and ($D_S$) is:

$$r_c = \frac{D_S}{D_D} \qquad \text{Equation 2}$$

The preferable range of values for $r_c$ is:

$$0.25<r_c<0.90 \qquad \text{Equation 3}$$

Figure 3:
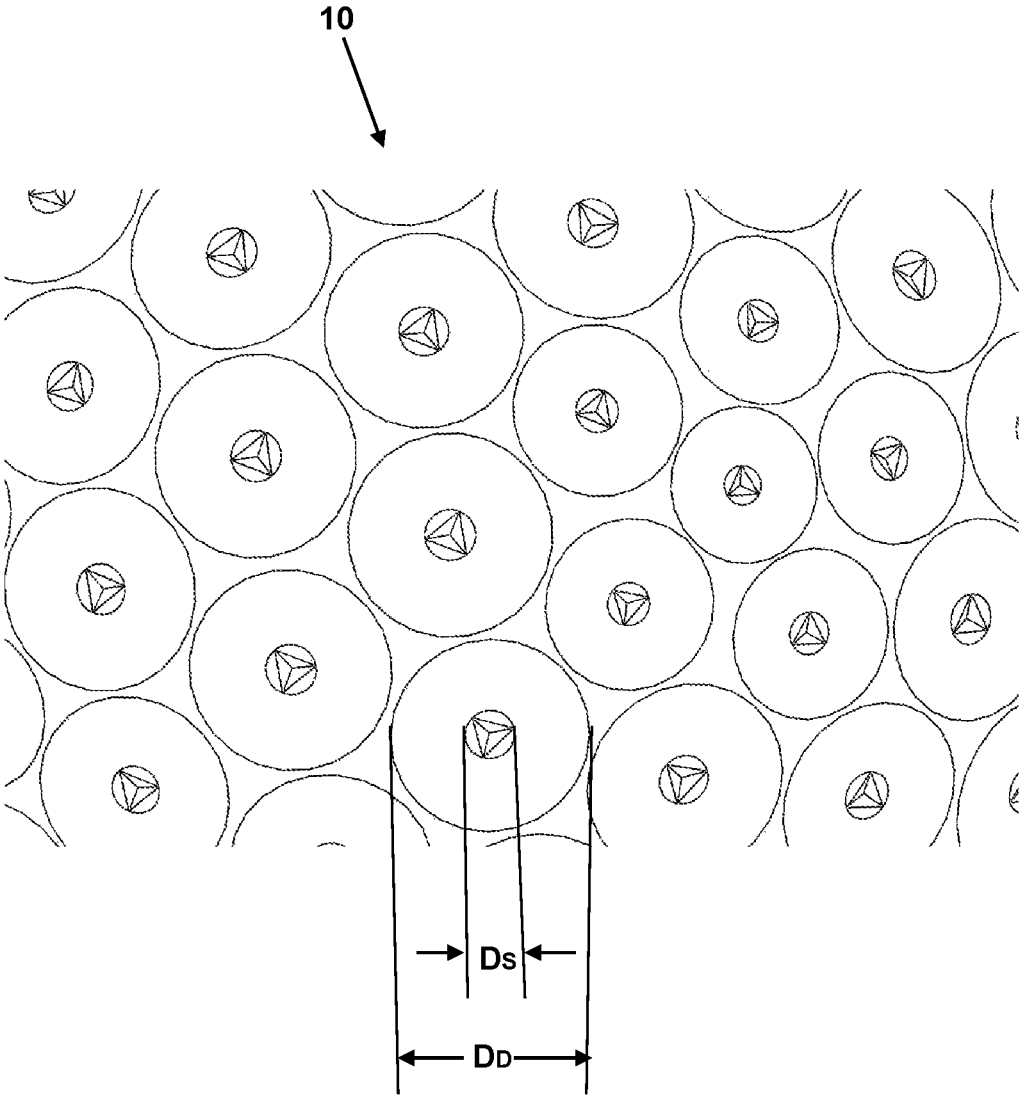
FIG. 3 is a partial surface of a golf ball having a circle ratio of 0.25.
Figure 4:
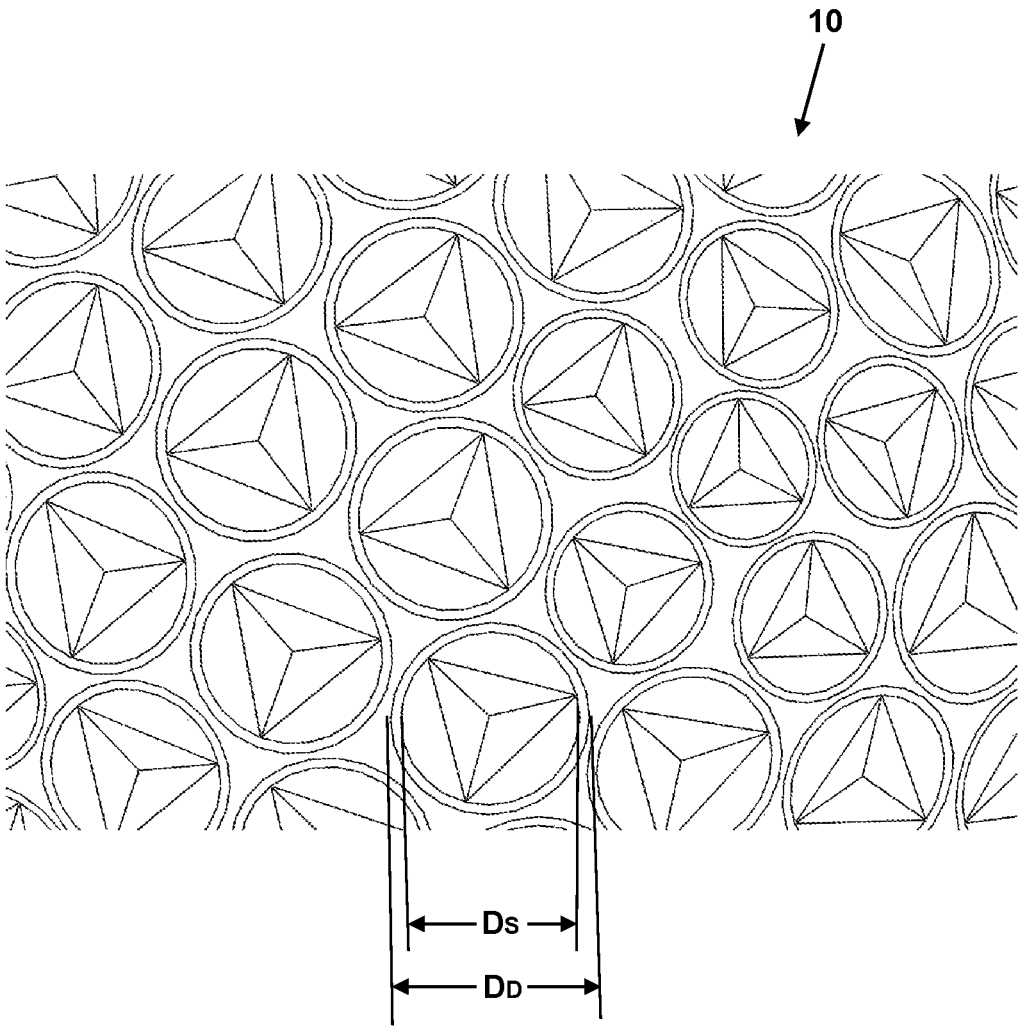
FIG. 4 is a partial surface of a golf ball having a circle ratio of 0.90.
Figure 5:
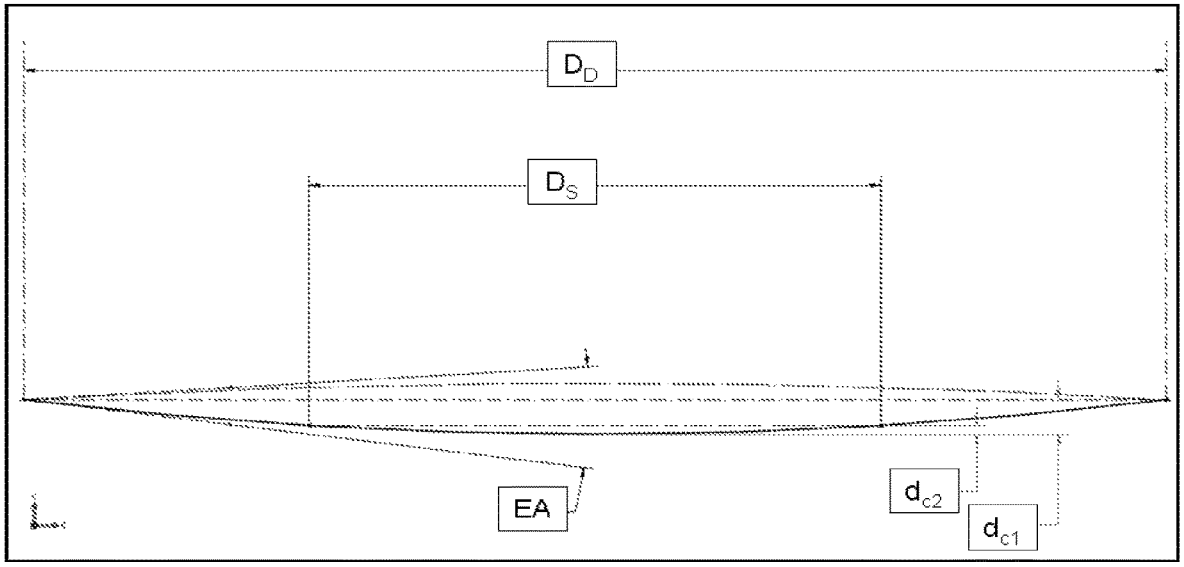
FIG. 5 is a schematic of the circle ratio of a dimple.
Figure 6:
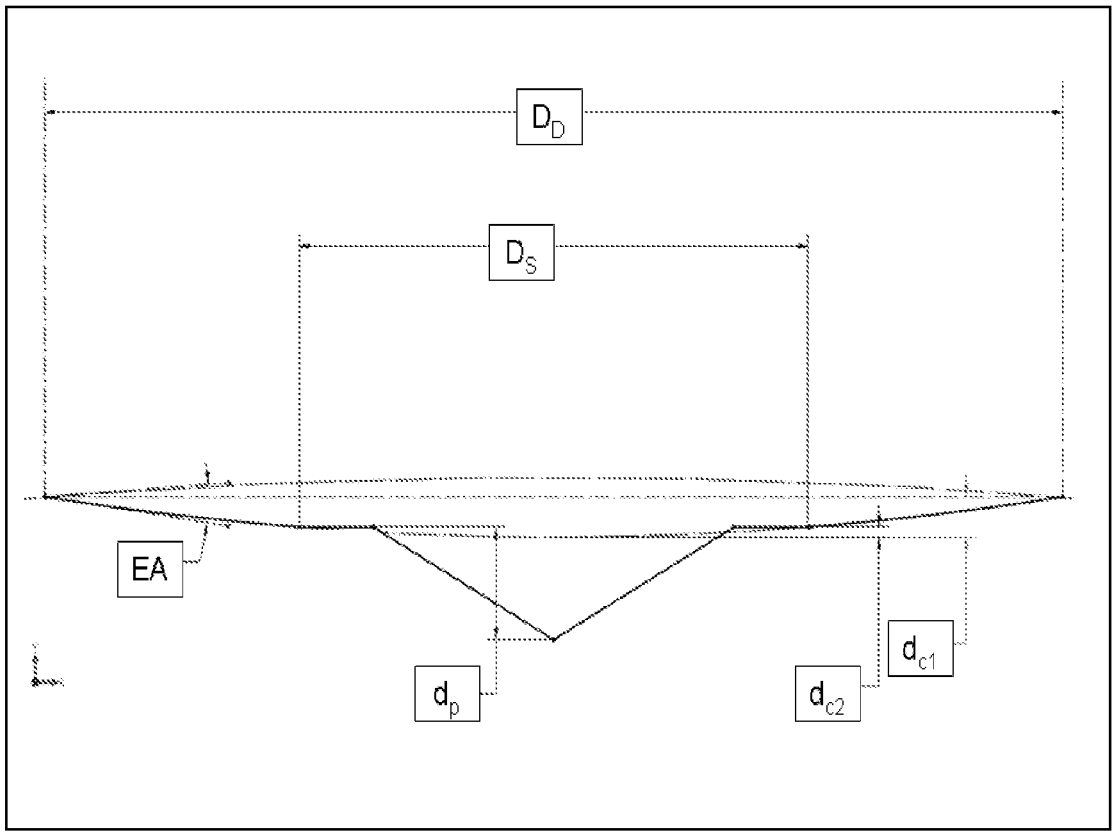
FIG. 6 is a schematic indicating edge angle and depth of the prismatoid.

Examples of circle ratios are shown in FIGS. 3 and 4, wherein circle ratios of 0.25 and 0.90 are respectively depicted, and a schematic of the ratios is illustrated in FIG. 5.

Depending on whether the prismatoid is a depression or protrusion, the volume is a summation from the initial dimple extent, and to calculate for the two discrete geometries is generally done using a CAD package to accurately compute the dimple volume.

The chordal volume of the entire dimple, $V_D$ is then:

$$V_D=V_E+V_P \qquad \text{Equation 4}$$

where $V_E$ is the dimple extent volume and $V_P$ represents the volume of the prismatoid.

The dimple volume, $V_D$, must be such that each dimple maintains an effective theoretical edge angle ($EA_X$). The effective theoretical edge angle is determined by computing the equivalent spherical dimple edge angle EA with dimple volume $V_D$ on a golf ball with a diameter ($D_B$). The dimple diameter ($D_D$) is the weighted average for the specific pattern.

Figure 7:
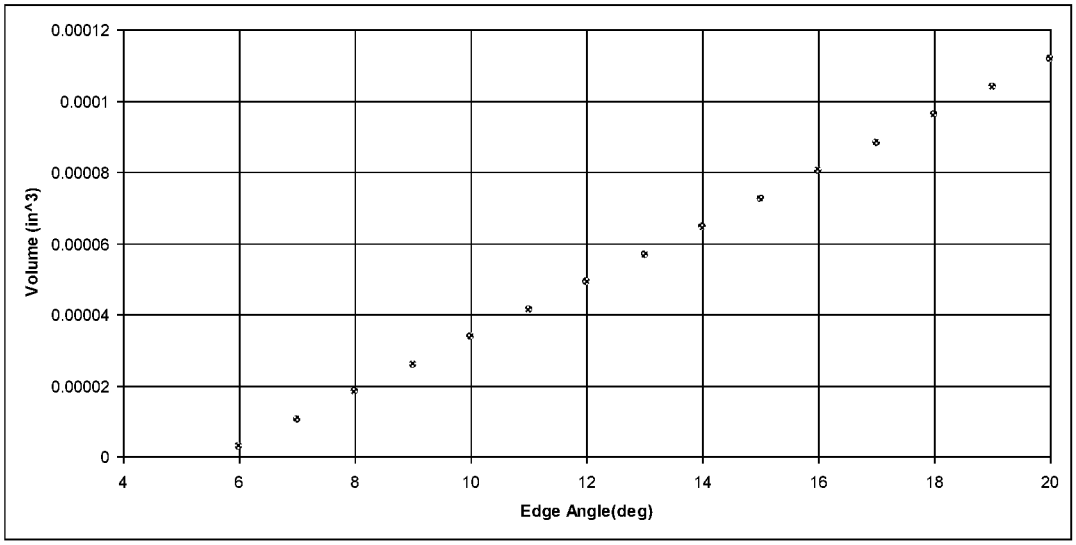
FIG. 7 is a chart of edge angle versus dimple volume.
Figure 8:
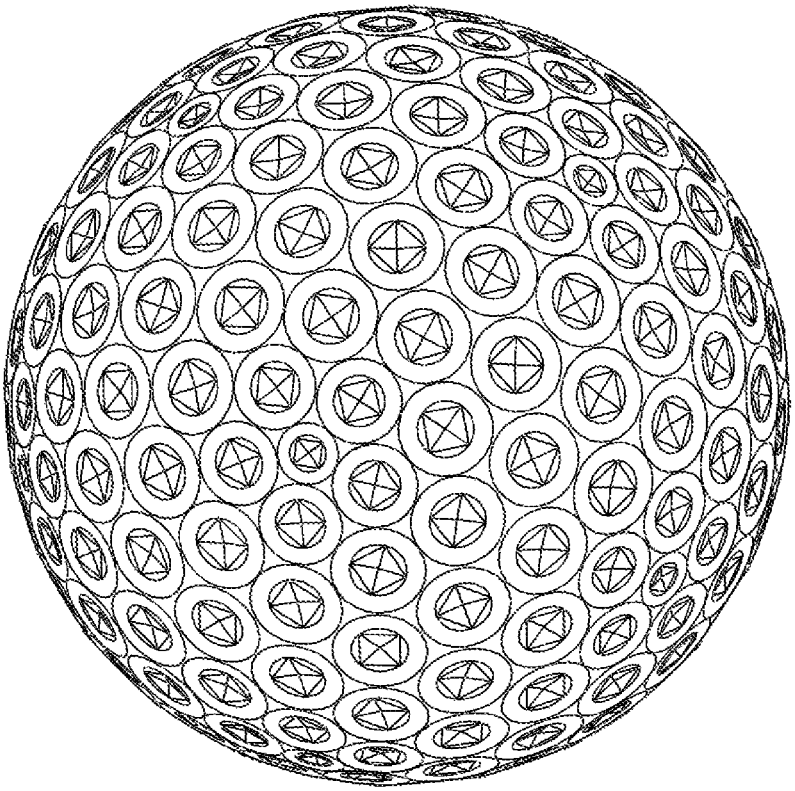
FIG. 8 shows a golf ball with multifaceted depressions according to an embodiment of the present invention.

For a given dimple diameter, the chordal volume has an approximately linear relationship to the edge angle of the dimple. For example, an average dimple diameter of 0.165 inches, a plot of edge angle versus chordal dimple volume is shown in FIG. 7. It is to be appreciated that the edge angle is the sum of the chordal and cap angles. When the chordal angle is zero, the chordal volume is also zero and the edge angle is equal to the cap angle. Thus, the plot is only valid for edge angles greater than the cap angle for a given dimple diameter (for FIG. 7 the edge angle is 5.64°). The plot shows a linear relationship between chordal volume and edge angle, which is instrumental in determining the effective theoretical edge angle, $EA_X$.

The effective theoretical edge angle is determined by first computing the slope of the line relating chordal volume to dimple edge angle for the weighted average dimple diameter ($D_D$). This is calculated as the ratio of cap volume $V_C$ to cap angle $A_C$ as seen in equation 5.

$$m = \frac{V_C}{A_C} \qquad \text{Equation 5}$$

The effective theoretical edge angle $EA_X$ is calculated as the ratio of the volume $V_D$ to the slope plus the included cap angle, as shown is equation 6.

$$EA_X = \frac{V_D}{m} + A_C \qquad \text{Equation 6}$$

The dimple is designed such that the effective theoretical edge angle $EA_X$ is:

$$9°<EA_X<18° \qquad \text{Equation 7}$$

more preferably:

$$12°<EA_X<16° \qquad \text{Equation 8}$$

In a particular embodiment, the present invention is directed to a dimple having a circumscribed prismatoid depression and a spherical cap bottom portion defined by a spherical surface blended into the sidewalls of the prismatoid depression. In a particular aspect of this embodiment, the spherical cap intersects with each edge of the prismatoid depression at a prescribed point of tangency, and the spherical cap does not maintain the same tangency with the sidewalls of the prismatoid depression. In another particular aspect of this embodiment, the spherical cap does not maintain a point of tangency with the edges or sidewalls of the prismatoid depression. In this particular aspect, in a dimple cross-sectional profile along at least one edge of the prismatoid depression, the spherical cap meets the edge of the prismatoid depression at an intersection point where no tangency exists and the angular difference between the prismatoid edge and the line in the dimple cross-sectional profile that is tangent to the spherical cap at the point of intersection between the spherical cap and the prismatoid edge is at least 2°.

Figure 18A:
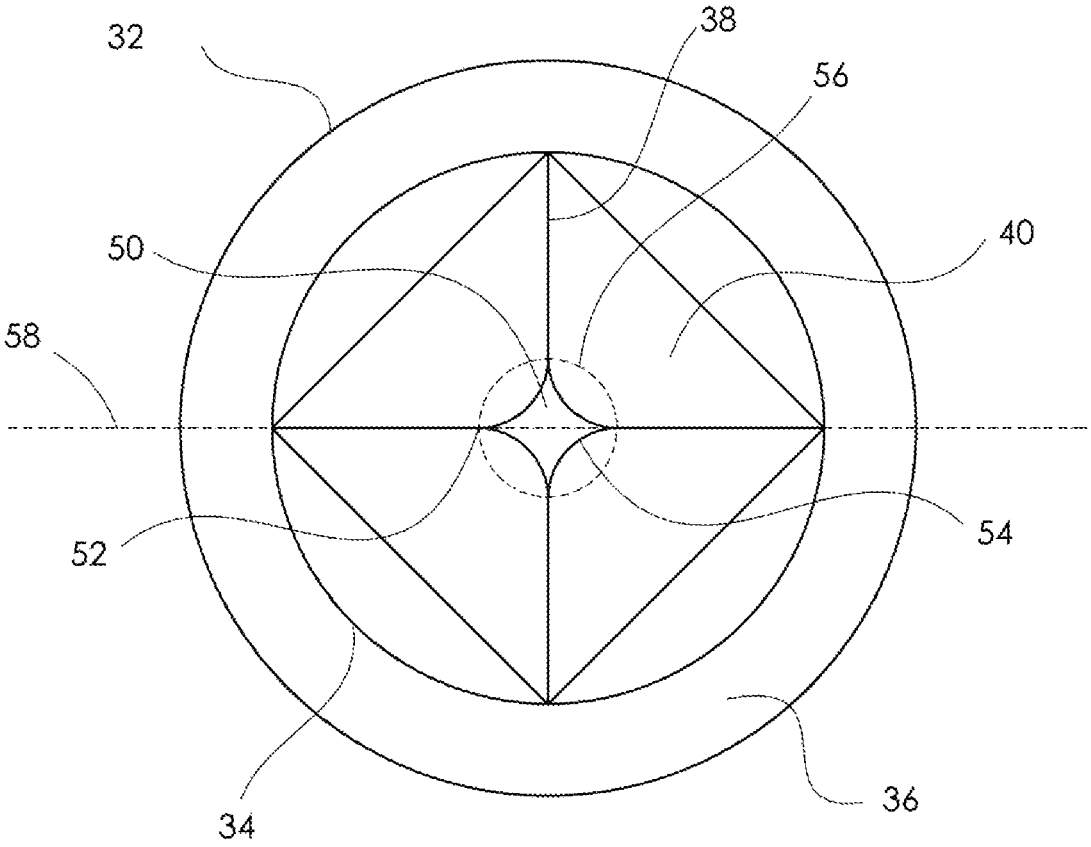
FIG. 18A is a plan shape view illustrating a dimple according to an embodiment of the present invention.
Figure 19A:
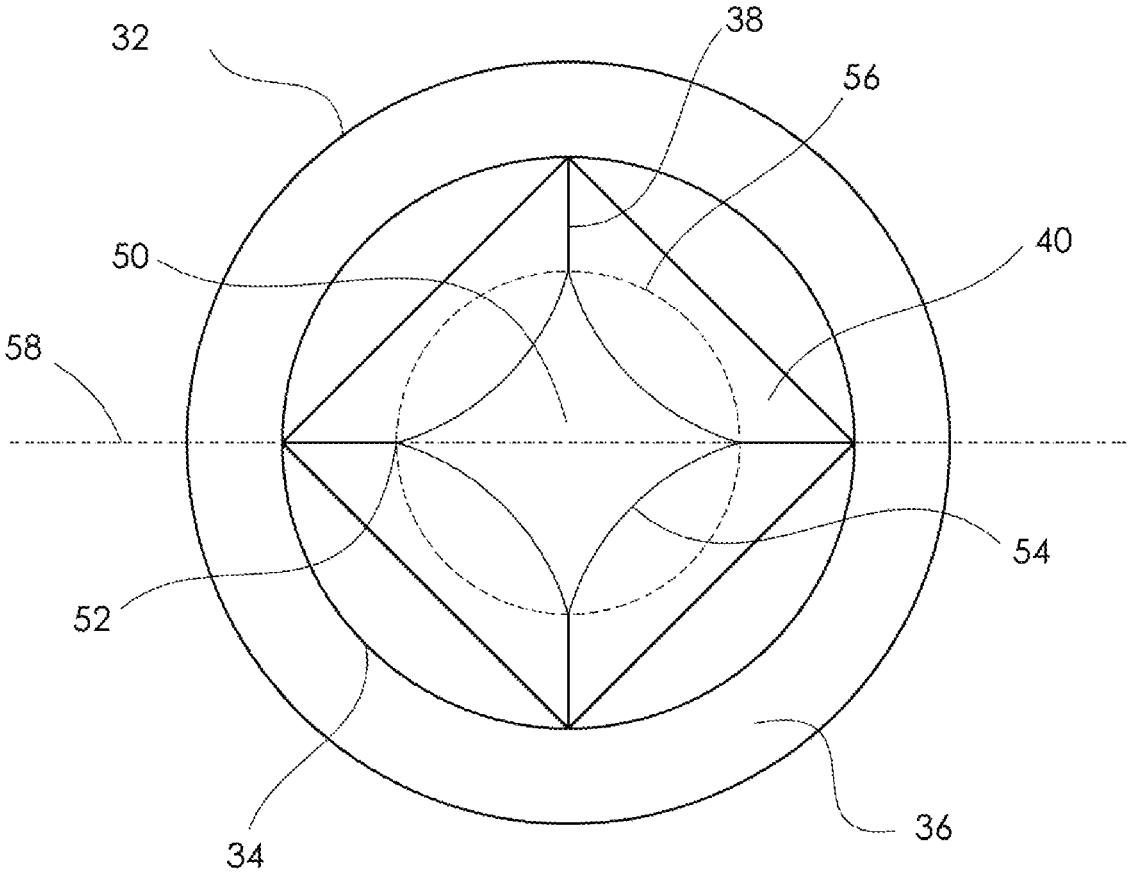
FIG. 19A is a plan shape view illustrating a dimple according to an embodiment of the present invention.

In dimples of the present invention which include a spherical cap bottom portion, the preferred size of the spherical cap bottom portion relative to the prismatoid depression is defined as follows. It should be understood that the curve of intersection of the spherical cap and the prismatoid depression, when viewed normal to the dimple chord plane, is not a circle, as shown in FIGS. 18A and 19A and further discussed below. Thus, when viewed normal to the dimple chord plane, a first reference circle encompassing the spherical cap and a second reference circle encompassing the prismatoid depression are drawn. The first reference circle encompassing the spherical cap is drawn as the circle having the minimum diameter that contacts the spherical cap in three or more points and encompasses all points of the spherical cap, the diameter of the first reference circle being defined as $D_{cap}$. The second reference circle encompassing the prismatoid depression is drawn as the circle having the minimum diameter that contacts the vertices of the base of the prismatoid, the diameter of the second reference circle being defined as $D_{prismatoid}$. $D_{cap}$ is related to $D_{prismatoid}$ such that $0.05 \leq r_{cap} \leq 0.80$, where $$r_{cap} = \frac{D_{cap}}{D_{prismatoid}}.$$

In a further particular aspect, $r_{cap}$ equals the circle ratio, $r_c$, discussed further above.

Figure 18B:
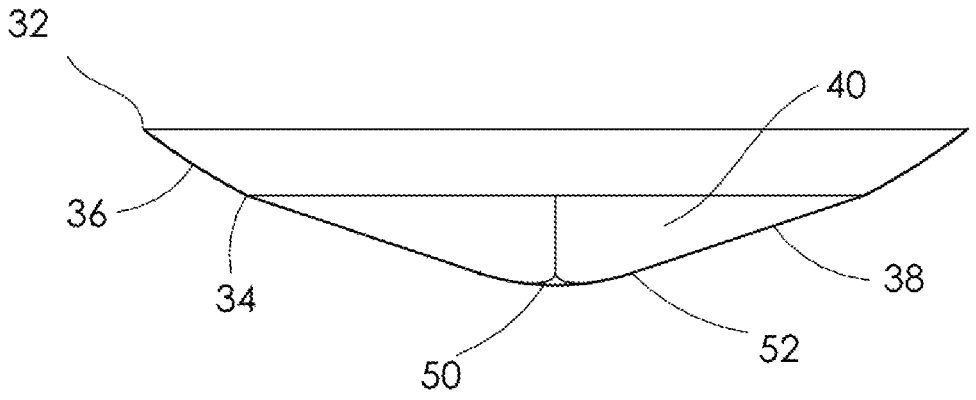
FIG. 18B is a profile view of the dimple shown in FIG. 18A.
Figure 18C:
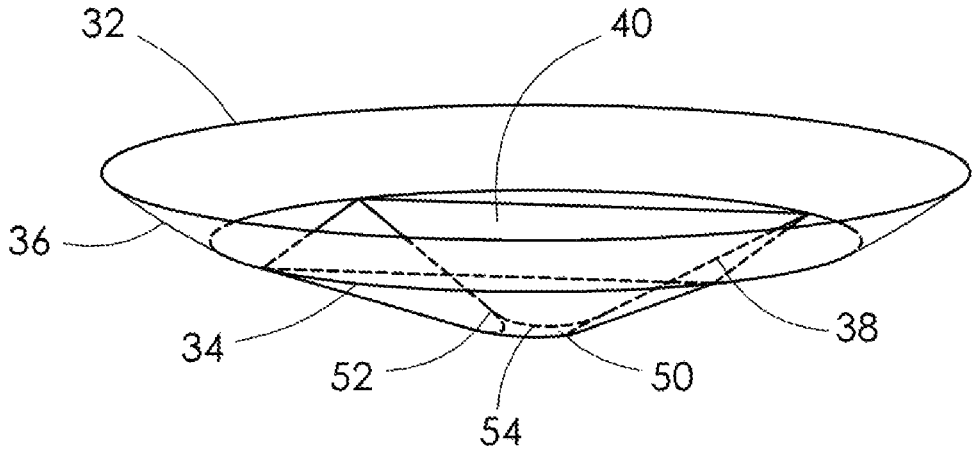
FIG. 18C is a perspective view of the dimple shown in FIG. 18A.

For example, FIGS. 18A-18C show a circumscribed prismatoid dimple including an upper dimple portion, a lower dimple portion, and a spherical cap, according to an embodiment of the present invention, wherein a flat transitional surface connects the upper dimple portion and the lower dimple portion. FIG. 18B is a profile view in the cut plane 58. The upper dimple portion is defined by a first circular perimeter 32 located at the chord plane, an upper dimple sidewall 36, and a circular perimeter 34 located at the intersection of the upper dimple portion with the flat transitional surface. The cross-sectional shape of upper dimple sidewall 36 is defined by a spherical function. The lower dimple portion is defined by a depression having the shape of a portion of a prismatoid, the prismatoid being formed by connecting each of the vertices of a polygonal base to an apex to form a pyramid consisting of the polygonal base and a plurality of triangular faces 40 joined along a plurality of side edges 38. The lower dimple portion intersects with spherical cap 50 along a curved interface 54 defined by the curve of intersection of the lower dimple portion and the spherical cap. There is no tangency between the triangular faces 40 and spherical cap 50 along curved interface 54. Spherical cap 50 maintains a point of tangency with each side edge 38 of the pyramid at intersection points 52. A reference circle 56, shown as a dotted circle in FIG. 18A, is the circle having the minimum diameter that contacts the spherical cap in three or more points and encompasses all points of the spherical cap. Circular perimeter 34 is equivalent to the circle having the minimum diameter that contacts the vertices of the base of the prismatoid. In a particular aspect of the embodiment shown in FIGS. 18A-18C, circular perimeter 32 has a diameter of 0.180 inches, circular perimeter 34 has a diameter of 0.135 inches, and reference circle 56 has a diameter of 0.034 inches.

Figure 19B:
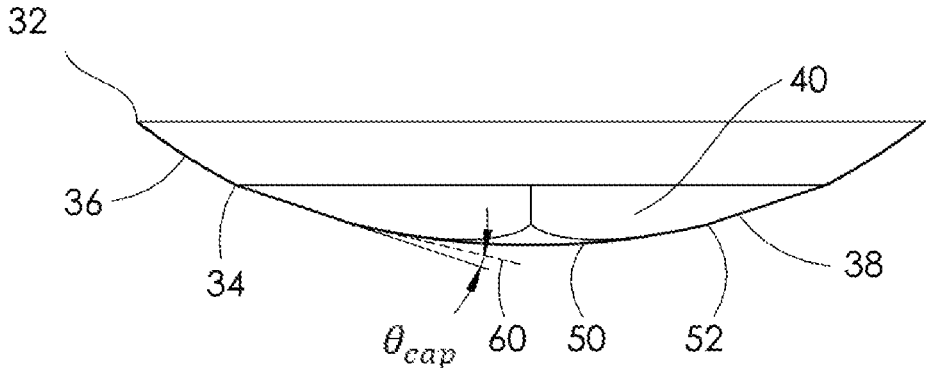
FIG. 19B is a profile view of the dimple shown in FIG. 19A.
Figure 19C:
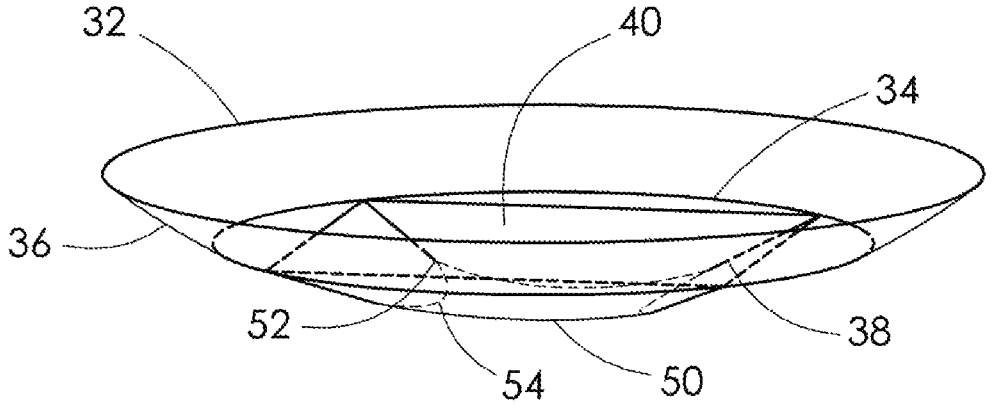
FIG. 19C is a perspective view of the dimple shown in FIG. 19A.

FIGS. 19A-19C show a circumscribed prismatoid dimple including an upper dimple portion, a lower dimple portion, and a spherical cap, according to another embodiment of the present invention, wherein a flat transitional surface connects the upper dimple portion and the lower dimple portion. FIG. 19B is a profile view in the cut plane 58. The upper dimple portion is defined by a first circular perimeter 32 located at the chord plane, an upper dimple sidewall 36, and a circular perimeter 34 located at the intersection of the upper dimple portion with the flat transitional surface. The cross-sectional shape of upper dimple sidewall 36 is defined by a spherical function. The lower dimple portion is defined by a depression having the shape of a portion of a prismatoid, the prismatoid being formed by connecting each of the vertices of a polygonal base to an apex to form a pyramid consisting of the polygonal base and a plurality of triangular faces 40 joined along a plurality of side edges 38. The lower dimple portion intersects with spherical cap 50 along a curved interface 54 defined by the curve of intersection of the lower dimple portion and the spherical cap. There is no tangency between the triangular faces 40 and spherical cap 50 along curved interface 54. There is no tangency between spherical cap 50 and side edge 38 at intersection points 52. As shown in FIG. 19B, a reference line 60 is drawn as the line that is tangent to spherical cap 50 in the profile view at intersection point 52. In a particular aspect of the embodiment shown in FIGS. 19A-19C, the angular difference, $\theta_{cap}$, between reference line 60 and side edge 38 is about 3°. A reference circle 56, shown as a dotted circle in FIG. 19A, is the circle having the minimum diameter that contacts the spherical cap in three or more points and encompasses all points of the spherical cap. Circular perimeter 34 is equivalent to the circle having the minimum diameter that contacts the vertices of the base of the prismatoid. In a particular aspect of the embodiment shown in FIGS. 19A-19C, circular perimeter 32 has a diameter of 0.180 inches, circular perimeter 34 has a diameter of 0.135 inches, and reference circle 56 has a diameter of 0.081 inches.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball having recessed dimples on the surface thereof, wherein at least one dimple consists of:

an upper dimple portion defined by a circular perimeter located at the chord plane, and an upper dimple sidewall, wherein the cross-sectional profile shape of the upper dimple sidewall is defined by a spherical function;

a lower dimple portion defined by a depression having the shape of a portion of a prismatoid, wherein the prismatoid is formed by connecting each of the vertices of a polygonal base to an apex to form a pyramid consisting of the polygonal base and a plurality of triangular faces joined along a plurality of side edges, wherein the surface shape of the lower dimple portion includes at least a portion of each of the triangular faces; and a spherical cap connected to the lower dimple portion at a perimeter boundary;

wherein a flat transitional surface connects the upper dimple portion and the lower dimple portion, and.

2. The golf ball of claim 1, wherein the spherical cap does not maintain a point of tangency with the triangular faces of the pyramid at the perimeter boundary.

3. The golf ball of claim 2, wherein the spherical cap maintains a point of tangency with each side edge of the pyramid at the perimeter boundary.

4. The golf ball of claim 2, wherein the spherical cap does not maintain a point of tangency with the side edges of the pyramid at the perimeter boundary.

5. The golf ball of claim 4, wherein the spherical cap meets each side edge of the pyramid at an intersection point and the angular difference between the side edge and the line in the dimple cross-sectional profile that is tangent to the spherical cap at the point of intersection between the spherical cap and the side edge is at least 2°.

6. The golf ball of claim 1, wherein a first reference circle encompassing the spherical cap is drawn as the circle having the minimum diameter that contacts the spherical cap in three or more points and encompasses all points of the spherical cap, a second reference circle encompassing the prismatoid depression is drawn as the circle having the minimum diameter that contacts the vertices of the base of the pyramid, and the diameter of the first reference circle, $D_{cap}$, is related to the diameter of the second reference circle, $D_{prismatoid}$, such that:

$$0.05 \le r_{cap} \le 0.80, \text{ where } r_{cap} = \frac{D_{cap}}{D_{prismatoid}}.$$

7. The golf ball of claim 1, wherein the vertices of the pyramid are in contact with the circular perimeter.

8. The golf ball of claim 1, wherein the vertices of the pyramid are not in contact with the circular perimeter.

9. A golf ball having recessed dimples on the surface thereof, wherein at least one dimple consists of:

an upper dimple portion defined by a circular perimeter located at the chord plane, and an upper dimple sidewall, wherein the cross-sectional profile shape of the upper dimple sidewall is defined by a spherical function;

a lower dimple portion defined by a depression having the shape of a portion of a prismatoid, wherein the prismatoid is formed by connecting each of the vertices of a polygonal base to an apex to form a pyramid consisting of the polygonal base and a plurality of triangular faces joined along a plurality of side edges, wherein the surface shape of the lower dimple portion includes at least a portion of each of the triangular faces; and a spherical cap connected to the lower dimple portion at a perimeter boundary;

wherein the upper dimple portion intersects with the lower dimple portion along a curved interface, and the lower dimple portion intersects with the spherical cap along a curved interface.

10. The golf ball of claim 9, wherein the spherical cap does not maintain a point of tangency with the triangular faces of the pyramid.

11. The golf ball of claim 10, wherein the spherical cap maintains a point of tangency with each side edge of the pyramid.

12. The golf ball of claim 10, wherein the spherical cap does not maintain a point of tangency with the side edges of the pyramid.

13. The golf ball of claim 12, wherein the spherical cap meets each side edge of the pyramid at an intersection point and the angular difference between the side edge and the line in the dimple cross-sectional profile that is tangent to the spherical cap at the point of intersection between the spherical cap and the side edge is at least 2°.

14. The golf ball of claim 9, wherein a first reference circle encompassing the spherical cap is drawn as the circle having the minimum diameter that contacts the spherical cap in three or more points and encompasses all points of the spherical cap, a second reference circle encompassing the prismatoid depression is drawn as the circle having the minimum diameter that contacts the vertices of the base of the pyramid, and the diameter of the first reference circle, $D_{cap}$, is related to the diameter of the second reference circle, $D_{prismatoid}$, such that:

$$0.05 \le r_{cap} \le 0.80, \text{ where } r_{cap} = \frac{D_{cap}}{D_{prismatoid}}.$$

15. The golf ball of claim 9, wherein the vertices of the pyramid are in contact with the circular perimeter.

16. The golf ball of claim 9, wherein the vertices of the pyramid are not in contact with the circular perimeter.

17. A golf ball having recessed dimples on the surface thereof, wherein at least one dimple comprises:

an upper dimple portion defined by a circular perimeter located at the chord plane, and an upper dimple sidewall, wherein the cross-sectional profile shape of the upper dimple sidewall is defined by a spherical function;

a lower dimple portion defined by a depression having the shape of a portion of a prismatoid, wherein the prismatoid is formed by connecting each of the vertices of a polygonal base to an apex to form a pyramid consisting of the polygonal base and a plurality of triangular faces joined along a plurality of side edges, wherein the surface shape of the lower dimple portion includes at least a portion of each of the triangular faces; and a spherical cap connected to the lower dimple portion at a perimeter boundary along a continuous interface between the spherical cap and each side edge and triangular face of the lower dimple portion, wherein the perimeter boundary comprises a plurality of boundary segments connecting adjacent side edges along the continuous interface.

18. The golf ball of claim 17, wherein the plurality of boundary segments are curved.

* * * * *